US009753418B2

(12) United States Patent
Takeda et al.

(10) Patent No.: US 9,753,418 B2
(45) Date of Patent: Sep. 5, 2017

(54) FIXING APPARATUS FOR FIXING A TONER IMAGE ON A RECORDING MEDIUM WHILE CONVEYING AND HEATING THE RECORDING MEDIUM

(71) Applicant: CANON KABUSHIKI KAISHA, Tokyo (JP)

(72) Inventors: Isamu Takeda, Machida (JP); Takanori Mitani, Meridian, ID (US); Akimichi Suzuki, Yokohama (JP); Satoshi Nishida, Numazu (JP); Hideo Nanataki, Yokohama (JP); Kazuhiro Doda, Yokohama (JP); Yasuhito Minamishima, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/164,737

(22) Filed: May 25, 2016

(65) Prior Publication Data

US 2016/0349682 A1 Dec. 1, 2016

(30) Foreign Application Priority Data

May 29, 2015 (JP) ..... 2015-110383

(51) Int. Cl.
*G03G 15/20* (2006.01)

(52) U.S. Cl.
CPC ..... *G03G 15/2064* (2013.01); *G03G 15/2053* (2013.01); *G03G 2215/2019* (2013.01)

(58) Field of Classification Search
CPC ..... G03G 15/2064; G03G 15/2053; G03G 2215/2019
See application file for complete search history.

(56) References Cited

U.S. PATENT DOCUMENTS 8,699,930 B2 * 4/2014 Tanaka ..... G03G 15/2057 399/327
2008/0298863 A1 * 12/2008 Nanataki ..... G03G 15/2039 399/335
2014/0003847 A1 * 1/2014 Nishida ..... G03G 15/2064 399/329

(Continued)

FOREIGN PATENT DOCUMENTS

JP 2003-114583 A 4/2003
JP 2004-138949 A 5/2004

(Continued)

*Primary Examiner* — Susan Lee

(74) *Attorney, Agent, or Firm* — Canon U.S.A. Inc., IP Division

(57) ABSTRACT

A fixing apparatus includes a roller, a heating rotation member configured to form a pressure portion by coming into contact with the roller, the heating rotation member being rotated by rotation of the roller, and a pressing rotation member configured to form a nip portion by coming into contact with the roller, the pressing rotation member being rotated by the rotation of the roller, wherein micro-hardness of a surface of the heating rotation member at the pressure portion and micro-hardness of a surface of the pressing rotation member at the nip portion are both higher than micro-hardness of a surface of the roller, and wherein frictional force acting on the roller at the pressure portion is larger than frictional force acting on the roller at the nip portion.

4 Claims, 13 Drawing Sheets

(56) References Cited

U.S. PATENT DOCUMENTS

| | | | | |
|---|---|---|---|---|
| 2014/0023413 | A1* | 1/2014 | Shinji | G03G 15/2057 399/329 |
| 2015/0331375 | A1* | 11/2015 | Takeda | G03G 15/2064 399/328 |

FOREIGN PATENT DOCUMENTS

| | | | |
|---|---|---|---|
| JP | 2008-268728 | A | 11/2008 |
| JP | 2011-95306 | A | 5/2011 |

* cited by examiner

FIXING APPARATUS FOR FIXING A TONER IMAGE ON A RECORDING MEDIUM WHILE CONVEYING AND HEATING THE RECORDING MEDIUM

BACKGROUND OF THE INVENTION

Field of the Invention

The present invention relates to a fixing apparatus used in an image forming apparatus such as an electrophotographic copying machine and an electrophotographic printer.

Description of the Related Art

As fixing apparatuses installed in image forming apparatuses such as copying machines and printers using electrophotographic techniques, ones including fixing rollers which are heated from their outer circumferential surfaces are known. The fixing apparatus generally includes a fixing roller, a heating rotation member for heating the fixing roller by coming into contact with the fixing roller, and a pressing roller for forming a nip portion by coming into contact with the fixing roller. A recording material on which a toner image is formed is conveyed to and heated at the nip portion, and thus the toner image is fixed to the recording material. As the heating rotation member of the fixing apparatus, there are a member including a cylindrical film and a heater coming into contact with an inner surface of the film, a member including a heating roller equipped with a halogen heater, and the like.

In the fixing apparatus, an event referred to as an offset may occur in some cases in which a portion of a toner on a recording material is transferred to an outer circumferential surface of the fixing roller. In this specification, a toner causing an offset is referred to as an offset toner. The offset toner may be transferred to and accumulated on a surface of the heating rotation member with the rotation of the fixing roller. The accumulated toner may form a lump and soil a toner image on a recording material by irregularly returning to a surface of the fixing roller.

Thus, a fixing apparatus is described in Japanese Patent Application Laid-Open No. 2003-114583 in which a non-adhesive property of a heating member with respect to a toner on a recording material is set higher than a non-adhesive property of a fixing roller. In the fixing apparatus, adhesive force between the offset toner and the fixing roller exceeds adhesive force between the offset toner and the heating member, and thus the offset toner on the fixing roller remains on the surface of the fixing roller without adhering to the heating member. Accordingly, the offset toner on the fixing roller surface can be fixed to the recording material with the rotation of the fixing roller and discharged.

However, there is an issue that it is not enough to differentiate a non-adhesive property of an external heating member and a non-adhesive property of the fixing roller surface in some cases, and the offset toner adheres to the external heating member.

SUMMARY OF THE INVENTION

As an aspect of the present invention, a fixing apparatus for fixing a toner image on a recording material while conveying and heating the recording material on which a toner image is formed at a nip portion, the fixing apparatus includes a heating rotation member configured to form a pressure portion by contacting the roller, the heating rotation member being rotated by rotation of the roller, and a pressing rotation member configured to form a nip portion by contacting the roller, the pressing rotation member being rotated by the rotation of the roller, wherein micro-hardness of a surface of the heating rotation member at the pressure portion and micro-hardness of a surface of the pressing rotation member at the nip portion are both higher than micro-hardness of a surface of the roller, and wherein frictional force acting on the roller at the pressure portion is larger than frictional force acting on the roller at the nip portion.

Further features of the present invention will become apparent from the following description of exemplary embodiments with reference to the attached drawings.

DESCRIPTION OF THE EMBODIMENTS

Various exemplary embodiments of the present invention will be described in detail below with reference to the attached drawings.

(1) Example of Image Forming Apparatus

Figure 1:
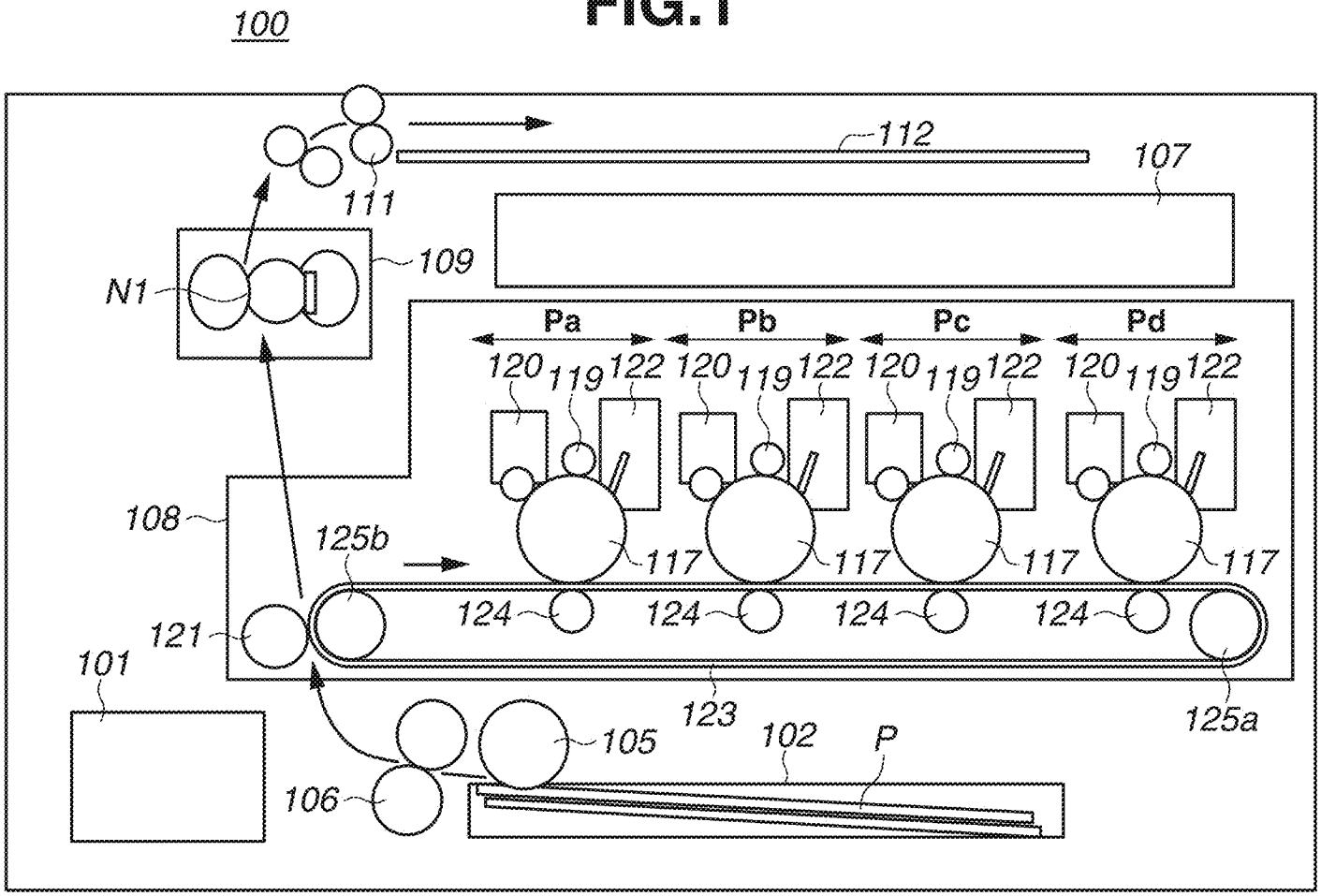
FIG. 1 is a cross-sectional view illustrating a schematic configuration of an image forming apparatus including a fixing apparatus according to the present invention.

FIG. 1 is a schematic cross-sectional view illustrating a schematic configuration on a transverse section of an image forming apparatus 100 including a fixing apparatus according to a first exemplary embodiment. The image forming apparatus is an electrophotographic laser beam printer.

The image forming apparatus according to the present exemplary embodiment is an in-line type apparatus in which first to fourth image forming units Pa, Pb, Pc, and Pd which form toner images using respective color toners of cyan, magenta, yellow, and black as developing agents are arranged in a line side by side in a predetermined direction. Each of the image forming units Pa, Pb, Pc, and Pd includes a drum shape electrophotographic photosensitive member (hereinbelow referred to as a photosensitive drum) 117 as an image bearing member.

In each of the image forming units Pa to Pd, a drum charge device 119 as a charging member and a scanning exposure apparatus 107 as an exposure unit are disposed around an outer circumferential surface (surface) of the photosensitive drum 117. A developing device 120 as a developing unit and a drum cleaner 122 are disposed around the surface of the photosensitive drum 117. Further, an intermediate transfer belt 123 as a conveyance member is disposed to extend over the photosensitive drum 117. The intermediate transfer belt 123 is wound around a driving roller 125*a* and a secondary transfer counter roller 125*b*.

Primary transfer rollers 124 are disposed on an inner circumferential surface (an inner surface) side of the intermediate transfer belt 123 so as to sandwich the intermediate transfer belt 123 between themselves and the respective photosensitive drums 117. A secondary transfer roller 121 is disposed on the outer circumferential surface (the surface) side of the intermediate transfer belt 123 so as to sandwich the intermediate transfer belt 123 between itself and the secondary transfer counter roller 125*b*.

In the image forming apparatus according to the present exemplary embodiment, a control unit 101 executes a predetermined image forming sequence in response to a print command output from an external apparatus (not illustrated) such as a host computer, a terminal apparatus on a network, and an external scanner. The control unit 101 includes a central processing unit (CPU) and memories such as a read-only memory (ROM) and a random access memory (RAM), and the memories store various programs and others necessary for the image forming sequence and image forming.

An image forming operation of the image forming apparatus according to the present exemplary embodiment is described with reference to FIG. 1. The control unit 101 successively drives each of the image forming units Pa, Pb, Pc, and Pd according to the image forming sequence executed in response to the print command. First, each photosensitive drum 117 is rotated in an arrow direction at a predetermined circumferential speed (a process speed), and also the intermediate transfer belt 123 is rotated by the driving roller 125*a* in an arrow direction at a circumferential speed corresponding to the rotation circumferential speed of each photosensitive drum 117. In the image forming unit Pa of yellow as a first color, a surface of the photosensitive drum 117 is uniformly charged to a predetermined polarity and potential by the drum charge device 119. Next, the scanning exposure apparatus 107 scans a charged surface of the photosensitive drum 117 by exposing it to a laser beam corresponding to image data (image information) output from the external apparatus. Accordingly, an electrostatic latent image (an electrostatic image) corresponding to the image data is formed on the charged surface of the surface of the photosensitive drum 117. The electrostatic latent image is developed by the developing device 120 using the yellow toner. Accordingly, a yellow toner image (a developed image) is formed on the surface of the photosensitive drum 117. Each of the charge, exposure, and development processes is similarly performed in the image forming unit Pb of magenta as the second color, the image forming unit Pc of cyan as the third color, and the image forming unit Pd of black as the fourth color. The toner image of each color formed on the surface of the respective photosensitive drum 117 is transferred on a surface of the intermediate transfer belt 123 in turn by the primary transfer roller 124 at a primary transfer nip portion between the surface of the photosensitive drum 117 and the surface of the intermediate transfer belt 123. Accordingly, a full color toner image is borne on the surface of the intermediate transfer belt 123.

Regarding the surface of the photosensitive drum 117 after transferring the toner image, a transfer residual toner remaining on the surface of the photosensitive drum 117 is removed by the drum cleaner 122 and used in next image forming. On the other hand, a recording material P such as a recording sheet is delivered one by one from a sheet cassette 102 by a delivery roller 105 and conveyed to a registration roller 106. The recording material P is conveyed by the registration roller 106 to a secondary transfer nip portion between the surface of the intermediate transfer belt 123 and an outer circumferential surface (a surface) of the secondary transfer roller 121. During the conveyance process, the toner image on the surface of the intermediate transfer belt 123 is transferred to the recording material P by the secondary transfer roller 121. Accordingly, an unfixed full color toner image is borne on the recording material P. The recording material P bearing the full color toner image is guide into a fixing nip portion N1 described below of a fixing apparatus 109. The recording material P is pinched and conveyed by the fixing nip portion N1, and heat and nip pressure are applied to the toner image, and thus the toner image on the recording material P is heated and fixed to the recording material P. The recording material P output from the fixing nip portion N1 is discharged onto a discharge tray 112 by a discharge roller 111.

(2) Fixing Apparatus (Fixing Unit)

In the following description, regarding the fixing apparatus and members constituting the fixing apparatus, a longitudinal direction represents a direction perpendicular to a recording material conveyance direction with respect to a surface of the recording material. A lateral direction represents a direction parallel to the recording material conveyance direction with respect to the surface of the recording material. A length represents a dimension in the longitudinal direction. A width represents a dimension in the lateral direction.

Figure 2:
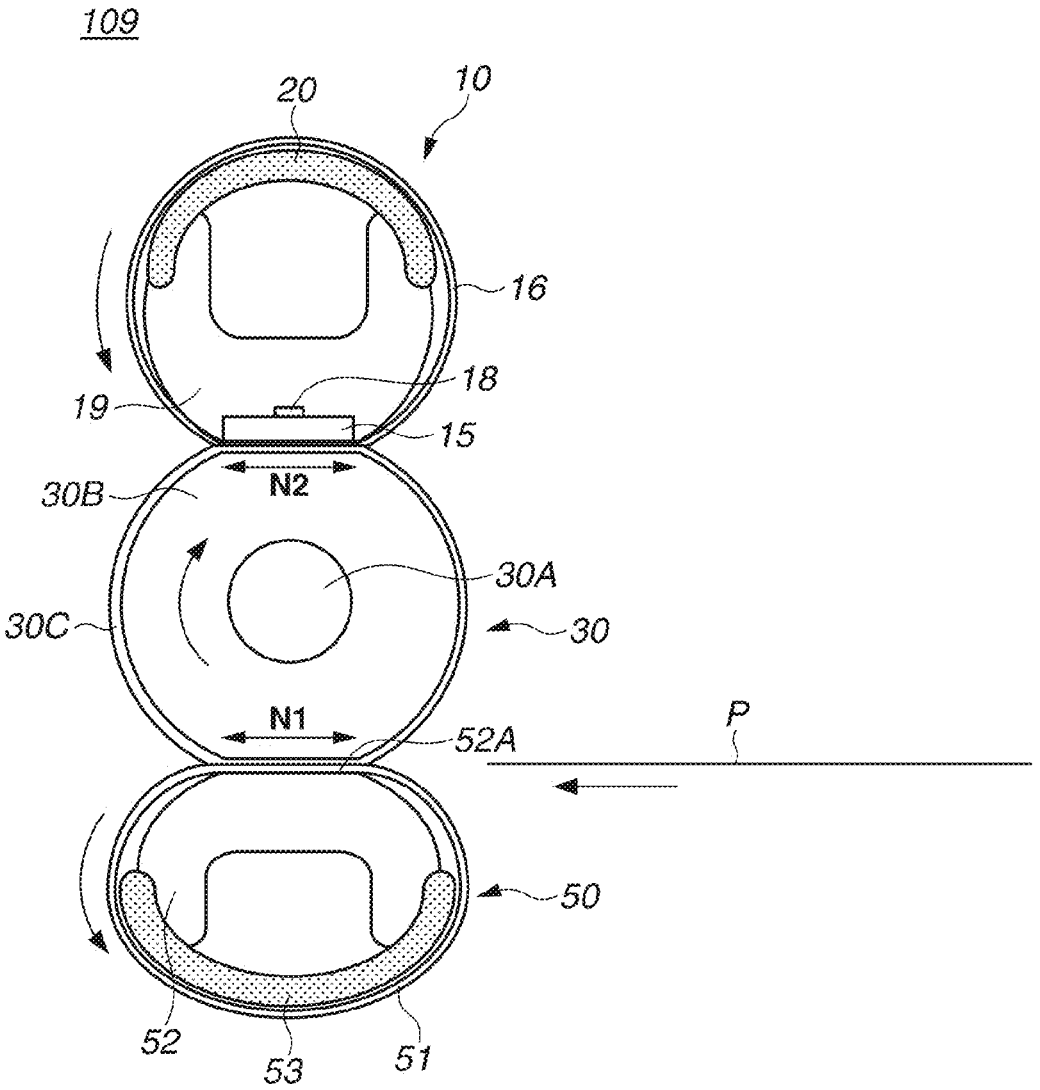
FIG. 2 is a cross-sectional view illustrating a configuration of the fixing apparatus according to the present invention.

FIG. 2 is a schematic cross-sectional view illustrating a schematic configuration of the fixing apparatus 109 according to the present exemplary embodiment. The fixing apparatus 109 is an external heating type fixing apparatus. The fixing apparatus 109 according to the present exemplary embodiment includes a fixing roller (a roller member) 30 as a fixing rotation member, a heating unit 10 as a heating rotation member, and a pressing unit 50 as a pressing rotation member.

(2-1) Fixing Roller 30

The fixing roller 30 includes a core metal 30A having a round shaft shape made of a metal material such as iron, stainless steel (SUS), and aluminum. An elastic layer 30B mainly containing silicone rubber is formed on an outer circumferential surface of the core metal 30A, and a releasing layer 30C mainly containing polytetrafluoroethylene (PTFE), tetrafluoroethylene-perfluoroalkyl vinyl ether (PFA), or fluorinated ethylene-propylene copolymer (FEP) is formed on an outer circumferential surface of the elastic layer 30B. Regarding the fixing roller 30, both end portions of the core metal 30A in the longitudinal direction are rotatably supported by side plates (not illustrated) of an apparatus frame (not illustrated) on both sides in the longitudinal direction via a bearing (not illustrated). In addition, the fixing roller 30 has the elastic layer 30B on a core metal 30A side to be a rotation center axis (a rotation center axis side) and thus has surface hardness of about 50° C.

(2-2) Heating Unit 10

The heating unit 10 includes the heater 15, a heater holder 19, the heating film 16 (a first film) having a cylindrical shape as the heating rotation member, and a heating film regulating member 20 (a first regulating member) for regulating a rotation orbit of the heating film. The heating film regulating member 20 is disposed so as to be in contact with an inner surface of an end portion of the heating film 16 with respect to a generatrix direction of the fixing roller 30. The heater holder 19 is formed so as to have a roughly U-shaped transverse section using a predetermined heat resistance material. The both end portions of the heater holder 19 in the longitudinal direction are held by the film regulating member 20 and supported by the side plates of the apparatus frame on both sides in the longitudinal direction. The heater 15 is supported by a groove disposed on a flat surface of the heater holder 19 along the longitudinal direction of the heater holder 19, and the heating film 16 is externally fitted to the heater holder 19 supporting the heater 15 in a loose manner. All of the heater 15, the heating film 16, and the heater holder 19 are members long in the longitudinal direction. In the heater 15, an energized heat generation resistor mainly containing silver, palladium, and the like is disposed in the longitudinal direction on a surface of a heater substrate having of a thin plate shape mainly containing ceramic, such as aluminum and aluminum nitride. Further, on the surface of the substrate, a protective layer made of glass and the like with high heat resistance is disposed so as to cover the energized heat generation resistor.

The heating film 16 is formed in such a manner that an inner circumferential length of the heating film 16 is longer than an outer circumferential length of the heater holder 19 and is externally fitted to the heater holder 19 in a loose manner with no tensile force. A layer structure of the heating film 16 is a two-layer structure in which an outer circumferential surface of an endless belt-shaped film base layer mainly containing polyimide and polyether ether ketone (PEEK) is covered with an endless belt-shaped surface layer mainly containing PFA.

Figure 3:
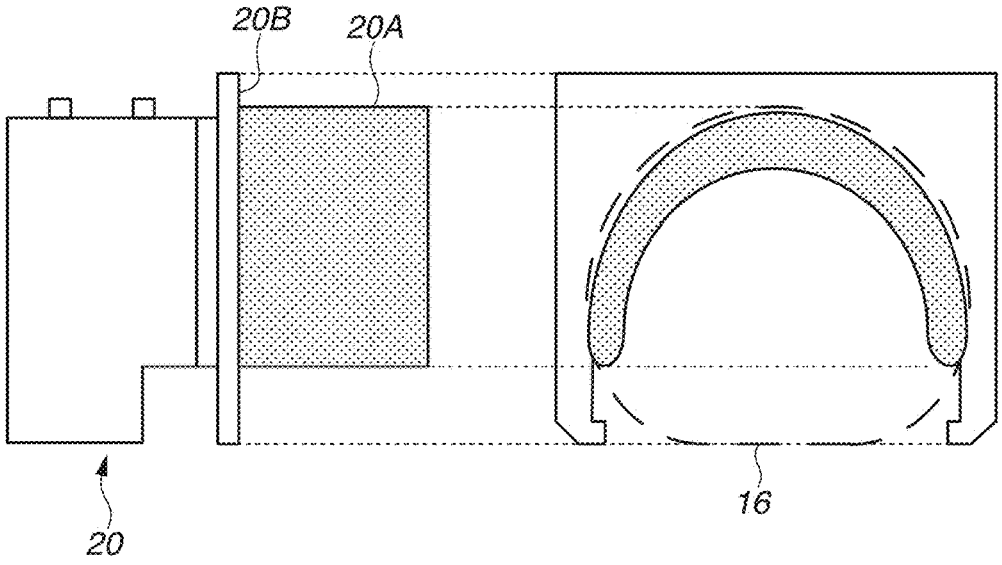
FIG. 3 is a schematic diagram illustrating a heating film regulating member according to a first exemplary embodiment.

FIG. 3 is a schematic diagram illustrating the heating film regulating member 20 according to the present exemplary embodiment. The heating film regulating member 20 is constituted of a surface 20A for regulating a film shape by coming into contact with an inner circumferential surface of the heating film 16 and a surface 20B for regulating a shift of the film in the longitudinal direction by causing the film end portion to come into contact therewith. It is desirable that the heating film regulating member 20 is formed by a material such as a fluororesin, polyimide, or polyamide-imide, which are resins having high slidability and of which a heat distortion temperature exceeds 200° C., and polyimide is used according to the present exemplary embodiment.

(2-3) Pressing Unit 50

The pressing unit 50 includes a pressing film 51 (a second film) having a cylindrical shape as a pressing rotation member, a pressing holder 52 as a nip portion forming member, and a pressing film regulating member 53 for regulating a shape of the pressing film 51. The pressing holder 52 is formed so as to have a roughly U-shaped transverse section using a predetermined heat resistance material. The both end portions of the pressing holder 52 in the longitudinal direction are held by the pressing film regulating member 53 and supported by the side plates of the apparatus frame on the both sides in the longitudinal direction. The pressing film 51 is externally fitted to the pressing holder 52 in a loose manner. Both of the pressing film 51 and the pressing holder 52 are members long in the longitudinal direction. A metal plate formed by aluminum and the like may be used as the nip portion forming member. The metal plate may be brought into contact with an inner surface of the pressing film 51 and configured to form a nip portion together with the fixing roller 30 via the pressing film 51. In the case that the metal plate is used as the nip portion forming member, it is desirable that a length in the recording material conveyance direction is set longer than the heater 15.

The pressing film 51 is formed in such a manner that an inner circumferential length of the pressing film 51 is longer than an outer circumferential length of the pressing holder 52 and is externally fitted to the pressing holder 52 in a loose manner with no tensile force. A layer structure of the pressing film 51 is a two-layer structure in which an outer circumferential surface of an endless belt-shaped film base layer mainly containing polyimide and PEEK is covered with an endless belt-shaped surface layer mainly containing PFA.

Figure 4:
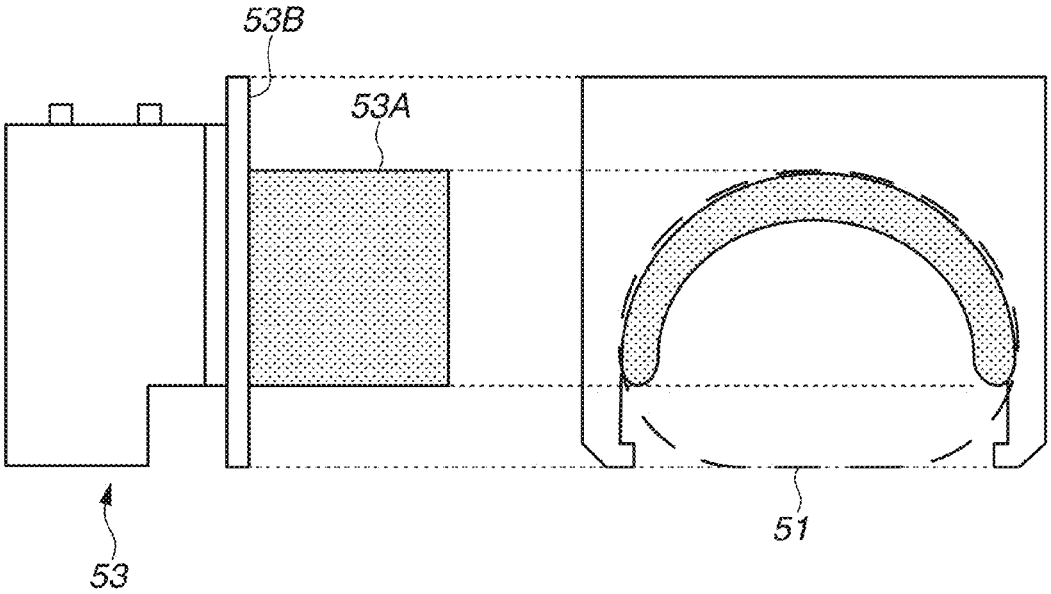
FIG. 4 is a schematic diagram illustrating a pressing film regulating member according to the first exemplary embodiment.

FIG. 4 is a schematic diagram illustrating the film regulating member 53 (a second regulating member) according to the present exemplary embodiment. Similar to the heating film regulating member 20, the pressing film regulating member 53 is constituted of a surface 53A for regulating a film shape by sliding on an inner circumferential surface of the film and a surface 53B for regulating a shift of the film in the longitudinal direction by causing the film end portion to abut thereon. It is desirable that the pressing film regulating member 53 is formed by a material such as a fluororesin, polyimide, or polyamide-imide, which are resins having high slidability and of which a heat distortion temperature exceeds 200° C., and polyimide is used according to the present exemplary embodiment.

Figure 13:
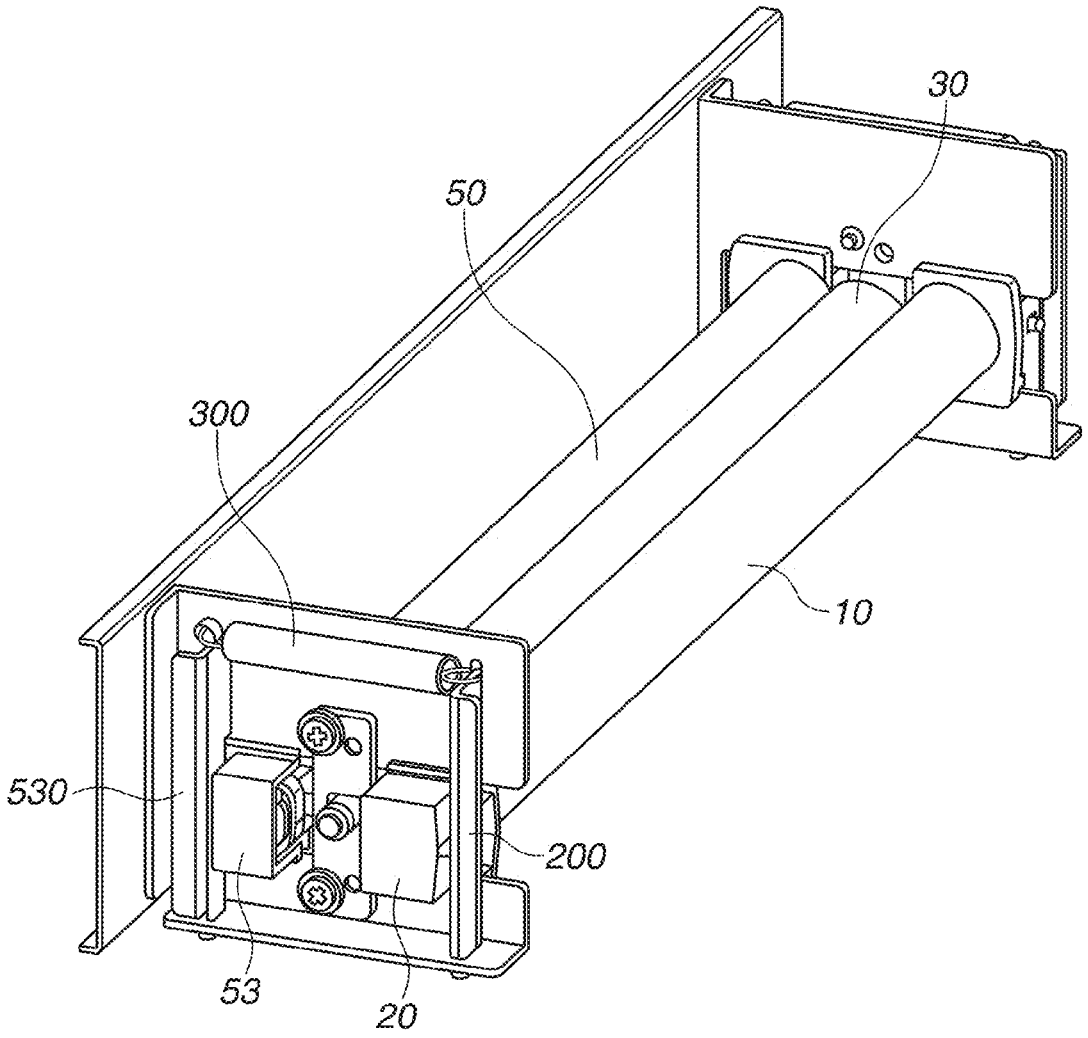
FIG. 13 illustrates a pressure mechanism of the fixing apparatus according to the first exemplary embodiment.

Next, a pressure mechanism is described with reference to FIG. 13. The heating unit 10, the pressing unit 50, and the fixing roller 30 are arranged in parallel. The heating film regulating member 20 disposed on the both end portions of the heating unit 10 in the longitudinal direction and the pressing film regulating member 53 disposed on the both end portions of the pressing unit 50 in the longitudinal direction are pulled by a spring 300 via respective pressing plates 200 and 530 across the fixing roller 30. Thus, urging force of the heating unit 10 toward the fixing roller 30 is equal to urging force of the pressing unit 50 toward the fixing roller 30. The heater 15 forms the heating nip portion N2 (a pressure portion) together with the fixing roller 30 via the heating film 16. The heater 15 serves as a pressure portion forming member. On the other hand, the pressing holder 52 forms the fixing nip portion N1 together with the fixing roller 30 via the pressing film 51.

Micro-hardness of the surface of the heating unit 10 at the heating nip portion N2 is higher than micro-hardness of the surface of the fixing roller 30 because of hardness of the glass protective layer of the heater 15 being in contact with an inner surface of the heating film 16. Micro-hardness of the surface of the pressing unit 50 at the fixing nip portion N1 is higher than the micro-hardness of the surface of the fixing roller 30 because of hardness of the pressing holder 52 as a backup.

(2-4) Heat Fixing Operation

Figure 5:
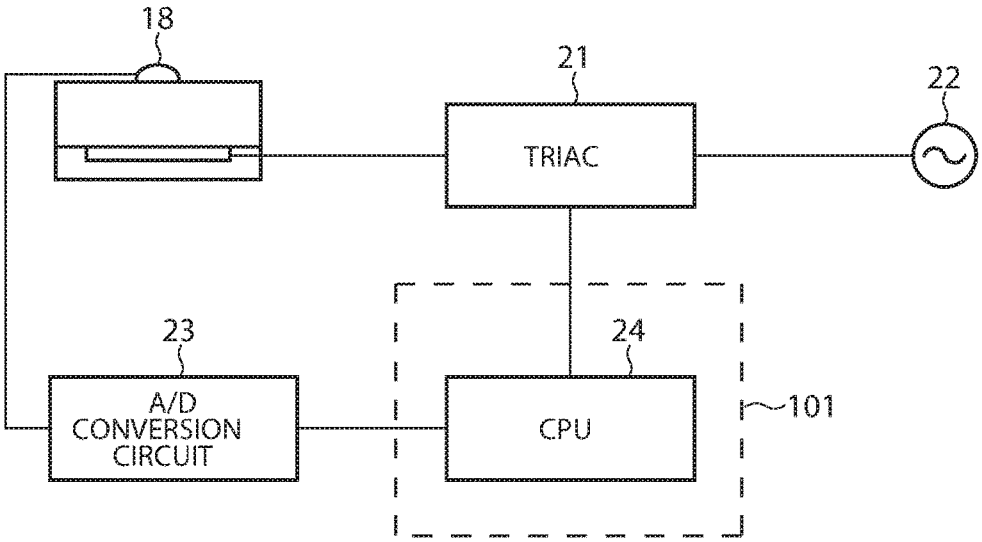
FIG. 5 illustrates a heater and an energization control system according to the first exemplary embodiment.

FIG. 5 illustrates the heater 15 and an energization control system. A heat fixing operation of the fixing apparatus 109 is described below with reference to FIGS. 1, 2 and 5. The control unit 101 drives and rotates a driving motor (not illustrated) as a driving source according to an image forming sequence executed in response to a print command. Rotation of an output shaft of the driving motor is transmitted to the core metal 30A of the fixing roller 30 via predetermined gear trains (not illustrated). Accordingly, the fixing roller 30 is rotated in an arrow direction at a predetermined circumferential speed (a process speed). Rotation driving of the fixing roller 30 is transmitted to the pressing film 51 at the fixing nip portion N1 by frictional force generated between the surface of the fixing roller 30 and the surface of the pressing film 51. Accordingly, the pressing film 51 is rotated in an arrow direction by following the rotation of the fixing roller 30 in a state in which the film shape of the pressing film 51 is regulated while an inner circumferential surface (an inner surface) of the pressing film 51 is in contact with a flat surface 52A of the pressing holder 52 and the surface 53A of the pressing film regulating member 53. Further, the rotation driving of the fixing roller 30 is transmitted to the heating film 16 at the heating nip portion N2 by frictional force generated between the surface of the fixing roller 30 and the surface of the heating film 16. Accordingly, the heating film 16 is rotated in an arrow direction by following the rotation of the fixing roller 30 in a state in which the film shape of the heating film 16 is regulated while the inner circumferential surface (the inner surface) of the heating film 16 is in contact with an outer surface of the heater 15 and a film sliding surface 20A of the heating film regulating member 20.

The control unit 101 turns on a triac 21 according to the image forming sequence. The triac 21 controls power applied from an alternate current (AC) power source 22 and starts energization to the heater 15. By the energization, a temperature of the heater 15 rapidly increases, and the heating film 16 is heated. The temperature of the heater 15 is detected by a thermistor 18 as a temperature detection member disposed on the surface of the substrate on the heater holder 19 side. The control unit 101 obtains an output signal (a temperature detection signal) from the thermistor 18 via an analog-to-digital (A/D) conversion circuit 23 and controls the triac 21 to maintain the heater 15 at a predetermined fixing temperature (a target temperature) based on the output signal. Accordingly, the heater 15 is maintained at the predetermined fixing temperature (the target temperature).

The surface of the fixing roller 30 in the rotation operation is heated at the heating nip portion N2 by the heater 15 via the heating film 16. Accordingly, the surface of the fixing roller 30 is supplied with an amount of heat necessary and sufficient to heat and fix an unfixed toner image T borne by the recording material P at the fixing nip portion N1. In a state in which the driving motor is rotationally driven, and the temperature of the heater 15 is controlled, the recording material P bearing the unfixed toner image T is guided into the fixing nip portion N1 with its toner image bearing surface upward. The recording material P is pinched between the surface of the fixing roller 30 and the surface of the pressing film 51 at the fixing nip portion N1 and conveyed in that state (pinch and conveyance). In the conveyance process, the toner image T is heated and melted on the surface of the fixing roller 30, a nip pressure is applied to the melted toner image T from the fixing nip portion N1, and accordingly, the toner image T is heated and fixed to the surface of the recording material P.

(3) Frictional Force

Figure 6:
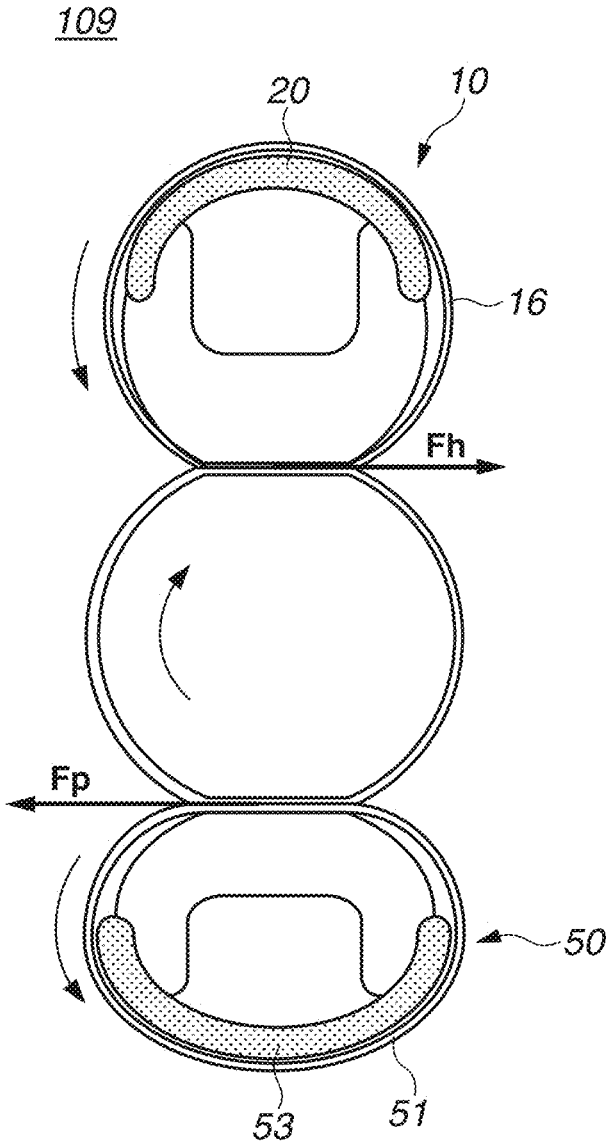
FIG. 6 is a schematic diagram illustrating frictional force generated on each member abutting on a fixing roller according to the first exemplary embodiment.

FIG. 6 is a schematic cross-sectional view illustrating frictional force Fh and its direction that the heating film 16 receives from the fixing roller 30 at the heating nip portion N2 and frictional force Fp and its direction that the pressing film 51 receives from the fixing roller 30 at the fixing nip portion N1 when the fixing roller 30 starts rotation. The fixing apparatus according to the present exemplary embodiment is configured so that the frictional force Fh received by the surface of the heating film 16 from the surface of the fixing roller 30 is larger than the frictional force Fp received by the surface of the pressing film 51 from the surface of the fixing roller 30. The frictional force Fh and the frictional force Fp are measured and compared, for example, as follows.

Figure 7A:
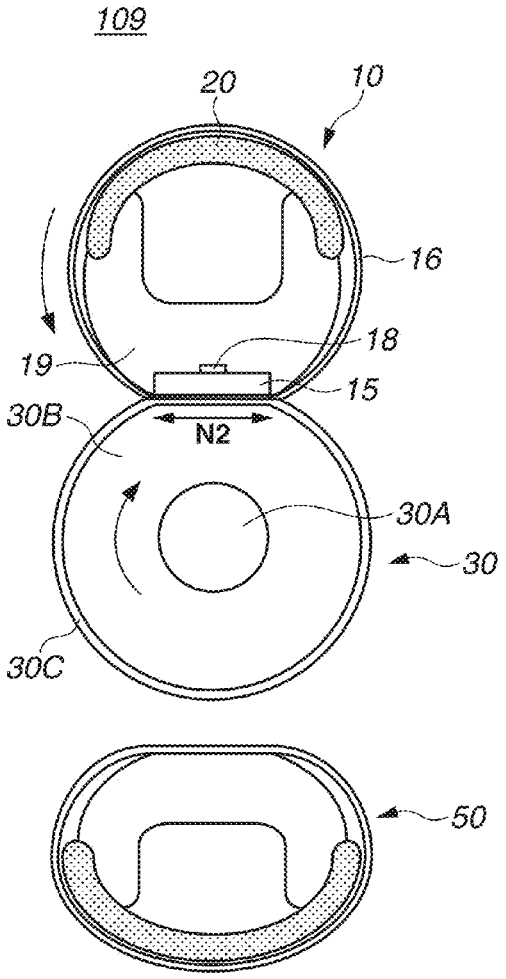
FIGS. 7A and 7B are schematic cross-sectional views of the fixing apparatus when frictional force is measured according to the first exemplary embodiment.
Figure 7B:
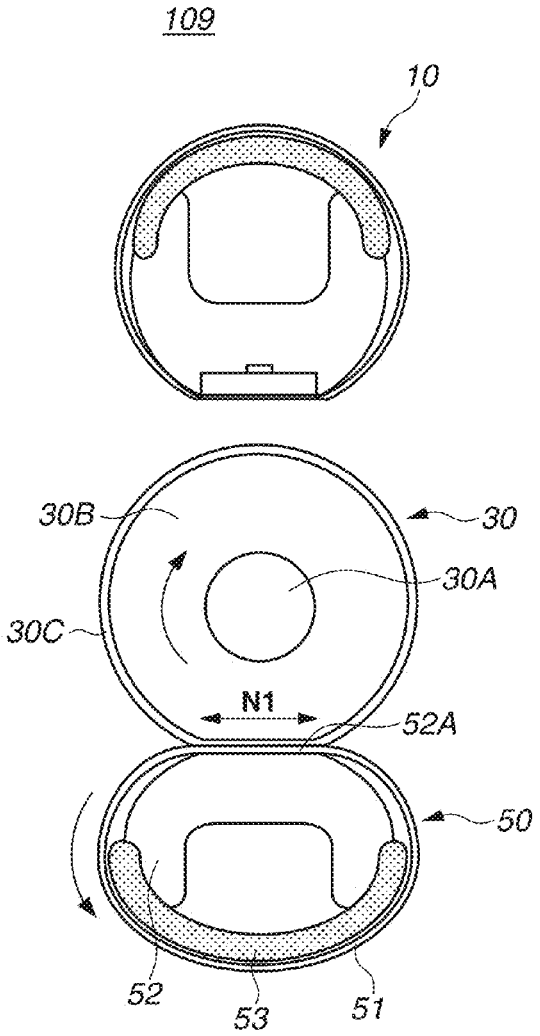

FIGS. 7A and 7B are schematic cross-sectional views illustrating the fixing apparatus when measuring the frictional force Fh and Fp. As illustrated in FIG. 7A, the pressing unit 50 is separated, and only the fixing roller 30 and the heating unit 10 abut on each other. The fixing roller 30 is rotationally driven at a speed equal to that of when printing is performed in the image forming apparatus, the heating film 16 is followingly rotated, and driving torque Th on the shaft of the fixing roller 30 is measured by a torque measurement apparatus (not illustrated). Next, as illustrated in FIG. 7B, the heating unit 10 is separated, and only the fixing roller 30 and the pressing film 51 abut on each other. Further, the fixing roller 30 is driven, and the pressing film 51 is also followingly rotated. Driving torque Tp on the shaft of the fixing roller 30 is measured by the torque measurement apparatus (not illustrated). The measured driving torque includes the frictional force for followingly rotating a member abutting on the surface of the fixing roller 30, namely the heating unit 10 or the pressing unit 50, and frictional resistance between a rotating shaft portion and the bearing of the fixing roller 30. Thus, the driving torque is obtained by the following equation.

Fixing Roller Driving Torque *Th*=Frictional Force *Fh**Radius *r* of Fixing Roller+Frictional Resistance *Fhj* of Fixing Roller Bearing*Radius *rj* of Shaft Fixing Roller Driving Torque *Tp*=Frictional Force *Fp**Radius *r* of Fixing Roller+Frictional Resistance *Fpj* of Fixing Roller Bearing*Radius *rj* of Shaft When the frictional resistance Frj and Fpj of the fixing roller bearing are negligibly small, the driving torque Th is compared with the driving torque Tp, and when the driving torque Th is larger, it can be said that the frictional force Fh is larger than the frictional force Fp. When the frictional resistance of the bearing of the fixing roller 30 is large as in the case of a sliding bearing or a shaft diameter is large, the torque Fhj*rj and Fpj*rj for rotating the fixing roller itself cannot be negligible. In such a case, a member which can sufficiently reduce rotational resistance of the fixing roller itself is used only when the torque is measured. For example, the torque for rotating the fixing roller itself may be reduced to a negligible degree by changing the sliding bearing to a rolling bearing, applying grease to the bearing, and the like. Subsequently, the driving torque of the fixing roller 30 is measured, and the frictional force is compared. Further, when the urging force of the heating unit 10 and the urging force of the pressing unit 50 toward the fixing roller 30 are equal, force pressing the shaft of the fixing roller 30 to the bearing is equal between when the driving torque Th is measured and when the driving torque Tp is measured regarding the fixing roller 30. In other words, the frictional resistance of the bearing of the fixing roller 30 is approximately equal to each other. The driving torque Th is compared with the driving torque Tp, and when the driving torque Th is larger, it can be determined that the frictional force Fh is larger than the frictional force Fp. When the frictional force Fh and Fp changes with temperature, a temperature of each member is adjusted to a temperature equivalent to that of a sheet P immediately before entering into a fixing nip at the time of actual fixing processing. For example, the fixing roller 30 is driven, and the heating film 16 is followingly rotated in a state in which the pressing unit 50 is separated, and only the heating unit 10 abuts on the fixing roller 30 as illustrated in FIG. 7A. Further, the heater 15 is energized to generate heat to raise a temperature of the heater 15, the heating film 16, and the fixing roller 30 to a temperature equivalent to that of the sheet P immediately before entering into the fixing nip portion N1 at the time of the heat fixing operation, and the driving torque Th on the shaft of the fixing roller 30 is measured.

Next, the fixing roller 30 abuts on the heating film 16 and the pressing film 51, and the heater 15 generates heat to raise the temperature of the heater 15, the heating film 16, the fixing roller 30, and the pressing film 51 to a temperature during the heat fixing operation or higher while the fixing roller 30 is rotationally driven. Then, the fixing roller 30 is driven, and the pressing film 51 is also followingly rotated in a state in which the heating unit 10 is separated, and only the fixing roller 30 and the pressing film 51 abut on each other as illustrated in FIG. 7B. When the surface temperature of the pressing film 51 drops to a temperature equivalent to that of the sheet P immediately before entering into the fixing nip portion N1 at the time of the heating operation, the driving torque Tp on the shaft of the fixing roller 30 is measured.

(4) Measure to Differentiate Frictional Force

Figure 8:
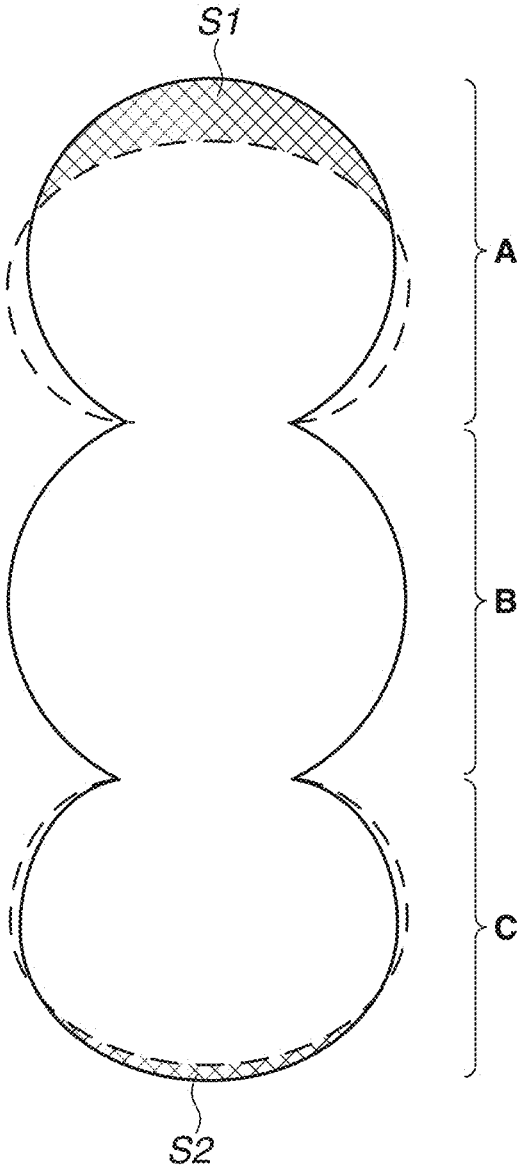
FIG. 8 illustrates a cross section shape of the fixing apparatus according to the first exemplary embodiment measured by a two-dimensional displacement sensor.

As a measure to make the frictional force Fh larger than the frictional force Fp, for example, the frictional force received by the inner surface of the heating film 16 from the contacting member thereof is made larger than the frictional force received by the inner surface of the pressing film 51 from the contacting member thereof. More specifically, it is configured to make the frictional force received by the inner surface of the heating film 16 from the surface 20A of the heating film regulating member 20 larger than the frictional force received by the inner surface of the pressing film 51 from the surface 53A of the pressing film regulating member 53. FIG. 8 illustrates a result obtained by measuring a cross section shape of the fixing apparatus 109 illustrated in FIG. 2 using a two-dimensional displacement sensor. The two-dimensional displacement sensors are disposed on an entry side and an exit side of the fixing nip portion N1 and perform measurement from the both sides, and thus a two-dimensional cross section shape of an entire fixing unit is measured. The measurement was performed using a high-accuracy two-dimensional laser displacement sensor LJ-G5000 (controller unit) and LJ-G200 (head unit) manufactured by Keyence.

A portion A in a solid line in FIG. 8 is an outline of a transverse section of the heating film 16 when the heating film regulating member 20 is provided. A portion B in a solid line in FIG. 8 is an outline of a transverse section of the fixing roller 30. A portion C in a solid line in FIG. 8 is an outline of a transverse section of the pressing film 51 when the pressing film regulating member 53 is provided. A portion A in a dashed line in FIG. 8 is an outline of the transverse section of the heating film 16 when the heating film regulating member 20 is removed. A portion C in a dashed line in FIG. 8 is an outline of the transverse section of the pressing film 51 when the pressing film regulating member 53 is removed.

An area S1 denotes an area of a region where the outline of the transverse section of the heating film 16 when the heating film regulating member 20 is provided (the solid line of the portion A) protrudes outside from the outline of the transverse section of the heating film 16 when the heating film regulating member 20 is removed (the dashed line of the portion A). An area S2 denotes an area of a region where the outline of the transverse section of the pressing film 51 when the pressing film regulating member 53 is provided (the solid line of the portion C) protrudes outside from the outline of the transverse section of the pressing film 51 when the pressing film regulating member 53 is removed (the dashed line of the portion C). The present exemplary embodiment is configured to make the area S1 larger than the area S2.

As the area S1 is larger, a pressure that the inner surface of the heating film 16 is in contact with the surface 20A of the heating film regulating member 20 becomes higher, and the frictional force becomes larger. On the other hand, a shape of the surface 53A of the pressing film regulating member 53 according to the present exemplary embodiment follows a shape of the pressing film 51 when the film shape is regulated only by the nip portion, so that the area S2 is small. Therefore, the frictional force received by the inner surface of the pressing film 51 from the surface 53A of the pressing film regulating member 53 is small compared to that of the heating unit 10. As described above, the present exemplary embodiment is configured to make the area S1 larger than the area S2. Accordingly, the frictional force received by the inner surface of the heating film 16 from the surface 20A of the heating film regulating member 20 becomes larger than the frictional force received by the inner surface of the pressing film 51 from the surface 53A of the pressing film regulating member 53.

(Accumulation of Contamination Toner to Heating Film)

When the toner image on the sheet P is heated and fixed thereon at the fixing nip portion N1, paper dust such as a paper fiber included in the sheet P and a filler (a filler material) including inorganic substance like calcium carbonate and talc may drop. A small amount of toner adhered to the fixing roller may adhere to and be mixed with a small amount of the paper dust including the inorganic substance and form a contamination toner which causes stain. The contamination toner is denoted as a toner Tc. The toner Tc and the paper dust come into contact with the heating film 16 at the heating nip portion N2 according to the rotation of the fixing roller 30. When the paper dust and the toner Tc are transferred to the heating film 16, releasability of the surface of the heating film 16 is deteriorated, and the toner Tc may further grow by collecting the toner and the paper dust. The toner has a tendency to move from a high temperature member to a low temperature member and basically has a tendency to easily move from the heating film 16 to the fixing roller 30, however, the toner Tc is mixed with the paper dust, and thus the toner Tc is less likely to be softened by heat applied with, and an adhesive property thereof is low. Thus, the toner Tc hardly peels off by a temperature difference between the surface of the heating film 16 and the surface of the fixing roller 30. The toner Tc firmly adhered to the surface of the heating film 16 may cause uneven transfer of heat to the fixing roller 30 and causes an image defect such as glossy unevenness and a streak in the fixed toner image on the sheet P. Further, after growing larger on the surface of the heating film 16, the toner Tc may be irregularly transferred to the fixing roller 30 and the sheet P and cause an image defect.

(Mechanism to Suppress Accumulation of Contamination Toner)

According to the present exemplary embodiment, adhesion and accumulation of a toner to the surface of the heating film 16, which is a conventional issue, can be suppressed. A mechanism thereof is described below. The following two types of force act on the toner Tc and the paper dust sandwiched between the fixing roller 30 and the film at the heating nip portion N2 and the fixing nip portion N1.

Wr: adhesion force of the toner Tc and the paper dust to the fixing roller 30

Wf: adhesion force of the toner Tc and the paper dust to the heating film 16 and the pressing film 51

It is highly likely that the toner Tc and the paper dust on the surface of the fixing roller 30 is transferred to the film when Wf>Wr and remains on the surface of the fixing roller 30 when Wf<Wr. The adhesion force Wf and Wr are constituted of an adhesive property of the toner, intermolecular force, electrostatic force, mechanical adhesion force to irregularity, and the like. In a state in which the fixing roller 30 and the film are not pressed and less deformed, surface energy and surface roughness of a surface of each member, a charged amount, and temperature, and the like dominantly determine the adhesion force. However, the adhesion force is largely changed by an action described below at the heating nip portion N2 and the fixing nip portion N1, and an effect of the action becomes dominant.

Figure 9:
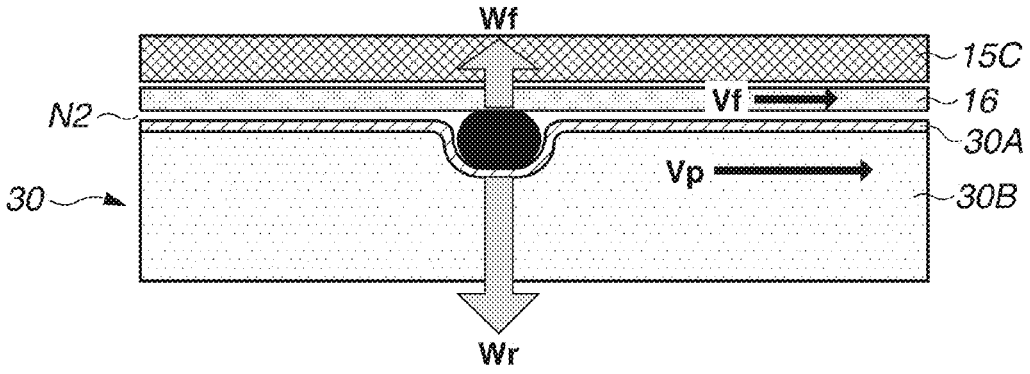
FIG. 9 is a schematic cross-sectional view illustrating a contact state between a heating film and a toner on the fixing roller, a circumferential speed, and force applied to the toner at a heating nip portion according to the first exemplary embodiment.

FIG. 9 is a schematic cross-sectional view illustrating deformation of the fixing roller 30, a contact area of the toner Tc, a circumferential speed of the heating film 16 and the fixing roller 30, and a force applied to the toner Tc at the heating nip portion N2.

The heating unit 10 is pressed by the fixing roller 30, and the surface of the fixing roller 30 is crushed and causes elastic deformation at the heating nip portion N2. The paper dust and the toner Tc mixed with the paper dust adhered to the surface of the fixing roller 30 are hard and hardly deformed, and thus the surface of the fixing roller 30 of which micro-hardness is relatively low is elastically deformed, and the contact area becomes large by following the paper dust and the toner Tc mixed with the paper dust. On the other hand, at the surface of the heating film 16, the heater 15 of which hardness is relatively high exists as a backup member, so that the micro-hardness thereof is higher, and the contact area is small without following the paper dust and the toner Tc mixed with the paper dust. A difference between the contact areas makes the adhesion force Wr to the surface of the fixing roller 30 larger than the adhesion force Wf to the heating film 16. Further, if there is a circumferential speed difference ΔV between a circumferential speed Vp of the surface of the heating film 16 and a circumferential speed Vp of the surface of the fixing roller 30 as illustrated in FIG. 9, the paper dust and the toner Tc bites into the elastic fixing roller 30 side and is rubbed against the surface of the heating film 16, and shear force is generated. Thus, the toner Tc becomes hard to adhere the heating film 16, and the adhesion force Wf becomes weak. As the circumferential speed difference is larger, the adhesion force Wf becomes smaller. When the circumferential speed difference ΔV between the heating film 16 and the fixing roller 30 cannot be observed, the similar effect can be caused if there is the frictional force of the inner surface of the heating film. A mechanism described below can be considered for the effect.

Figure 10:
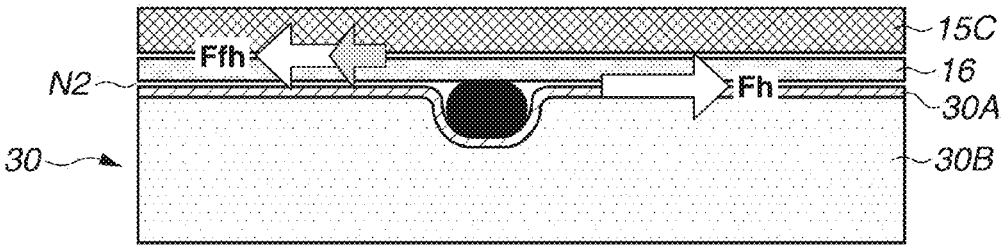
FIG. 10 is a schematic cross-sectional view illustrating a relationship of frictional force generated at the heating nip portion according to the first exemplary embodiment.

FIG. 10 is a schematic cross-sectional view illustrating a relationship between the frictional force received by the surface of the heating film 16 from the fixing roller 30 and the frictional force received by the inner surface of the heating film 16 from the heater 15 at the heating nip portion N2. The heating film 16 is followingly rotated by the frictional force Fh received by the heating film 16 from the fixing roller 30 at the heating nip portion N2. However, the fixing roller 30 receives frictional force Ffh received by the inner surface of the heating film 16 from the heater 15, and thus the surface of the fixing roller 30 is elastically deformed to distort toward the nip entry side and rotated with a delay with respect to the rotation of the core metal. More specifically, when the fixing roller 30 causes the heating film 16 remaining still to follow, the surface of the fixing roller 30 starts the rotation when the frictional force Fh exceeds the frictional force Ffh.

When the heating film 16 starts to follow the surface of the fixing roller 30, the frictional force Ffh of the film inner surface is changed from the static frictional force to the dynamic frictional force and decreased. Accordingly, the fixing roller 30 is released from a drag of the frictional force Ffh and returns to an original shape from the elastically deformed shape. At that time, the circumferential speed of the surface of the fixing roller 30 is temporarily increased and generates a minute circumferential speed difference with respect to the surface of the heating film 16. The minute circumferential speed difference exists in a state in which the fixing roller 30 and the heating film 16 are followingly rotated. However, a maximum circumferential speed difference is generated at a timing when the fixing roller starts the rotation operation from a resting state, and large shear force is obtained. The heating nip portion N2 is described above, however, the same can be applied to a relationship between the fixing roller 30 and the pressing film 51 at the fixing nip portion N1.

The present exemplary embodiment is configured to make the area S1 larger than the area S2 as described above. Accordingly, the frictional force received by the inner surface of the heating film 16 from the heating film regulating member 20 is larger than the frictional force received by the inner surface of the pressing film 51 from the pressing film regulating member 53. Further, the shear force at the heating nip portion N2 is larger than the shear force at a fixing nip portion, adhesion force Wfh of the paper dust and the toner Tc to the heating film 16 is smaller than adhesion force Wfp of the paper dust and the toner Tc to the pressing film 51.

Figure 11:
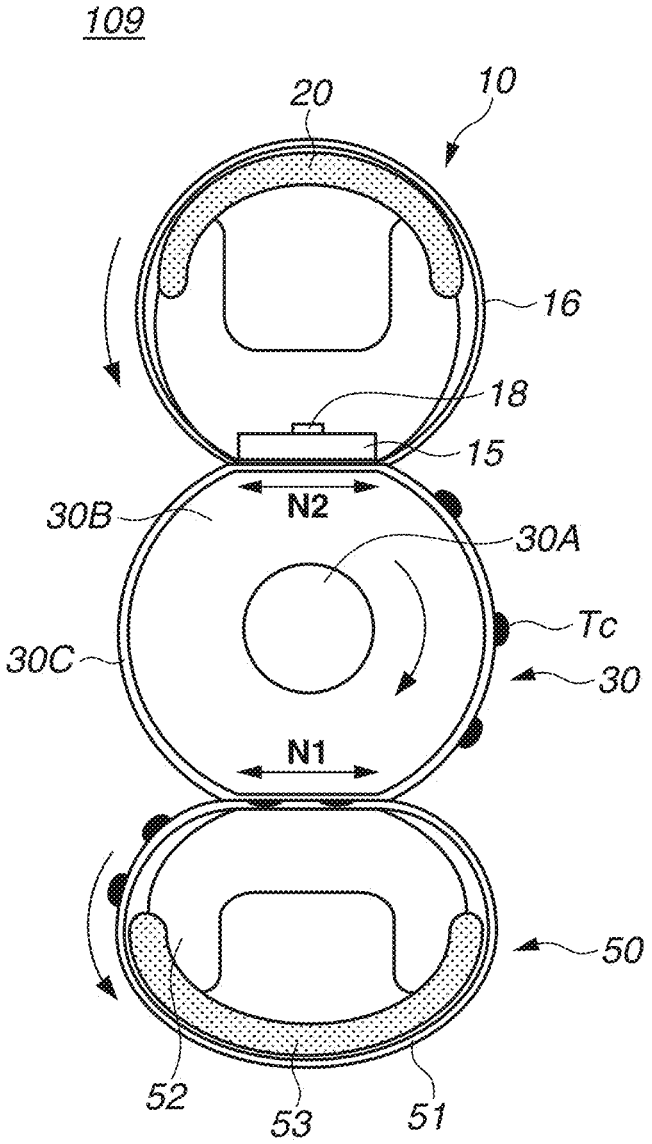
FIG. 11 is a schematic cross-sectional view illustrating movement of a toner on the fixing apparatus according to the first exemplary embodiment.

The adhesion force Wr of the toner Tc adhered to the surface of the fixing roller 30 at the time of the fixing processing is weakened because of the deformation of the fixing roller 30 at the respective positions in the heating nip portion N2 and the fixing nip portion N1. Then, the toner Tc tries to separate from the fixing roller 30, however, it is more likely that the toner Tc adheres to the pressing film 51 having stronger adhesion force Wfp rather than the heating film 16 having weaker adhesion force Wfh. The paper dust and the toner Tc adhered to the fixing roller 30 are preferentially transferred to the pressing film 51 and removed from the surface of the fixing roller 30 as illustrated in FIG. 11, and thus they are less likely to be transferred to the heating film 16. The toner Tc on the surface of the pressing film 51 can be discharged from the image forming apparatus when next heat fixing operation is performed on a sheet P by adhering to a rear surface of the sheet P at the fixing nip portion N1. A surface property of the sheet P such as paper is rough, and thus the toner Tc can easily adhere thereto. Further, even if the toner Tc is firmly adhered, when the sheet P on which the toner image is once formed and fixed is reversed and passes through the fixing nip portion N1 again, the toner Tc on the surface of the heating film 51 can be cleaned using adhesive force of the toner image.

As described above, the toner Tc and the paper dust adhered to the surface of the fixing roller 30 are discharged by being transferred to the surface of the pressing film 51 and further adhering to the sheet P from the pressing film 51, and thus transfer to the surface of the heating film 16 can be prevented, and an excellent image can be maintained.

(Experimental Result)

An effect of the fixing apparatus according to the present exemplary embodiment was confirmed by experiments. The image forming apparatus used in the experiment is a laser beam printer which has a process speed of 90 mm/s and can output 14 sheets of full color print per minute. The configuration of the fixing apparatus according to the present exemplary embodiment used in the experiment is described below.

The heater 15 includes a resistive heating member on an aluminum substrate with a thickness of 1 mm and a width of 7 mm and is covered with a glass layer with a thickness of 60 μm as a protective layer. The heating film 16 includes a releasing layer made of PFA resin with a thickness of 20 μm on a film base layer made of polyimide resin with an inner diameter of 20 mm and a thickness of 30 μm. Polyimide is used as a material of the heating film regulating member 20. Regarding the fixing roller 30, the elastic layer 30B made of silicone rubber having thermal conductivity of 0.2 W/m·K and a thickness of 3 mm is formed on the aluminum core metal 30A having an outer diameter 14 mm, and the releasing layer 30C made of PFA resin with a thickness of 20 μm is formed on an outermost layer. The Asker C hardness of the fixing roller 30 was 450. The Asker C hardness was measured using a load of 1 kgf by the Asker durometer type C (manufactured by KOBUNSHI KEIKI co., ltd.). The micro-hardness of the fixing roller 30 was 50°. The micro-hardness was measured by the Micro durometer MD-1 Type A indentor (manufactured by KOBUNSHI KEIKI co., ltd.). Regarding the pressing unit 50, the pressing film 51 is externally fitted to the pressing holder 52 made of liquid crystal polymer (LCP) resin. The pressing film 51 includes a releasing layer made of PFA resin with a thickness of 20 μm on a film base layer made of polyimide resin with an inner diameter of 20 mm and a thickness of 30 μm. The heater 15 is pressed to contact with the fixing roller 30 by a pressure (urging force) of 18 kg via the heating film 16 and forms the heating nip portion N2 with a width of 6 mm. The pressing holder 52 is pressed to contact with the fixing roller 30 by a pressure of 18 kg via the pressing film 51 and forms the fixing nip portion N1 with a width of 6 mm.

According to the present exemplary embodiment, the area S1 is 10 $cm^2$ which is the region where the outline of the transverse section of the heating film 16 when the heating film regulating member 20 is provided protrudes outside from the outline of the transverse section of the heating film 16 when the heating film regulating member 20 is removed. On the other hand, the area S2 is zero which is the region where the outline of the transverse section of the pressing film 51 when the pressing film regulating member 53 is provided protrudes outside from the outline of the transverse section of the pressing film 51 when the pressing film regulating member 53 is removed. Therefore, the present exemplary embodiment is configured to satisfy S1>S2. A comparative example is an apparatus in which the above-described areas S1 and S2 are both zero.

The frictional force Fh and Fp were measured using the above-described fixing apparatus. A method for measuring the frictional force Fh is described below. A state is set in which that the pressing unit 50 is separated from the fixing roller 30, and only the heating unit 10 is driven by the fixing roller 30. The heater 15 is controlled to be a target temperature of 200 degrees while the fixing roller 30 is rotationally driven, and the torque Th on the core metal shaft of the fixing roller 30 is measured by the torque measurement apparatus.

Next, a method for obtaining the frictional force Fp is described below. The fixing roller 30 is rotationally driven in a state in which the heating unit 10 and the pressing unit 50 abut on the fixing roller 30. Further, the heater 15 is energized to heat the fixing roller 30 and the pressing unit 50, and then energization of the heater 15 is stopped. Subsequently, the heating unit 10 is separated from the fixing roller 30, the fixing roller 30 is rotationally driven, and the torque Tp on the fixing roller shaft is measured when the temperature of the pressing film 51 becomes 70° C. Measurement results are presented in Table 1.

TABLE 1

| | S1 ($cm^2$) | Th (kgfcm) | Fh (kgf) | S2 ($cm^2$) | Tp (kgfcm) | Fp (kgf) |
|---|---|---|---|---|---|---|
| present exemplary embodiment | 10 | 2.2 | 2.2 | 0 | 1.8 | 1.8 |
| comparative example | 0 | 1.7 | 1.7 | 0 | 1.8 | 1.8 |

In the fixing apparatus according to the present exemplary embodiment which satisfies S1>S2, the frictional force Fh was larger than the frictional force Fp. On the other hand, in the fixing apparatus according to the comparative example in which S1=S2, there was little difference between the frictional force Fh and Fp.

Printing of characters and images was performed using the fixing apparatus and the image forming apparatus in an environment at an atmospheric temperature of 15° C. and a humidity of 15% using common laser beam printer (LBP) print sheets with a basis weight of 80 $g/m^2$ and an A4 size (a width of 210 mm and a length of 287 mm) at an image printing ratio 5%. According to the image forming apparatus in the present experiment, the heater 15 is controlled at the target temperature 200° C. when the full color print is performed by the image forming apparatus put in the environment at the atmospheric temperature of 15° C. in a fixing mode for performing fixing on, for example, a sheet having a basis weight of 80 $g/m^2$.

The fixing roller temperature and the pressing film temperature were not controlled, however, when temperatures were measured by a non-contact temperature meter, the fixing roller temperature was 150° C. and the pressing film temperature was 70° C. at immediately before the sheet P entering into the fixing nip portion N1 in the heating operation. The print mode was set to a mode in which jobs for printing two sheets are performed intermittently at 10-minute intervals. Results obtained by confirming a level of toner soiling on the surface of the heating film 16 and presence or absence of discharge of the toner Tc at a predetermined number of sheets are presented in Table 2.

TABLE 2

| | | 10K sheets | 25K sheets | 50K sheets | 75K sheets |
|---|---|---|---|---|---|
| soiling on heating film 16 | present exemplary embodiment | ○ | ○ | ○ | ○ |
| | comparative example | ○ | Δ | x | x |
| discharge of toner to image | present exemplary embodiment | ○ | ○ | ○ | ○ |
| | comparative example | ○ | ○ | x | x |

An interior of the fixing apparatus was observed when 25000 sheets were printed by the comparative example, and adhering substances such as the toner Tc slightly adhered to the heating film 16. However, there was nothing wrong with the fixed toner images on the printed sheets P. When 50000 sheets were further printed, fine-grained toner lumps were found in the fixed toner images on the sheets P. When the interior of the fixing apparatus was observed, adhesion of the toner Tc to the heating film 16 was increased. On the other hand, in the configuration according to the exemplary embodiment of the present invention, the adhering substances such as the toner Tc did not adhere to the heating film 16 when 75000 sheets were printed.

As described above, the fixing apparatus according to the present invention is configured to make the area S1 larger than the area S2. Accordingly, the frictional force between the heating film regulating member and the inner surface of the heating film becomes larger than the frictional force between the pressing film regulating member and the inner surface of the pressing film, accumulation of the toner Tc to the heating film 16 is suppressed, and an excellent print image can be maintained. In this regard, it is desirable to satisfy S1−S2>5 $mm^2$.

The image forming apparatus and the fixing apparatus according to a second exemplary embodiment are similar to those according to the first exemplary embodiment, and shapes of the heating film regulating member 20 and the pressing film regulating member 53 follow a film shape when the film shape is regulated only by the nip portion.

However, a measure to make the frictional force Fh larger than the frictional force Fp is as follows. Grease is applied as a lubricant to the inner surfaces of the heating film 16 and the pressing film 51, and a kinematic viscosity of the grease applied to the inner surface of the heating film 16 is set higher than a kinematic viscosity of the grease applied to the inner surface of the pressing film 51. Grease A is applied about 500 mg between the heater 15 and the heating film 16 as a lubricant. Further, grease B is applied about 500 mg between the pressing holder 52 and the pressing film 51. In the present experiment, fluorine greases having different molecular weights were respectively prepares for the grease A and the grease B. The grease A is higher in the kinematic viscosity than the grease B. The grease A has a molecular weight of 12500 and a kinematic viscosity of 200 (cSt) at 100° C., and the grease B has a molecular weight of 9800 and the kinematic viscosity of 45 (cSt) at 100° C. In the fixing apparatus according to the present exemplary embodiment, the grease A having the higher kinematic viscosity was applied to the heating unit 10, and the grease B having the lower kinematic viscosity was applied to the pressing unit 50. As the comparative example, the fixing apparatus (a comparative example 1) was prepared in which the grease B was used for both of the heating unit 10 and the pressing unit 50. Further, the fixing apparatus (a comparative example 2) was prepared in which the grease B having the lower kinematic viscosity was applied to the heating unit 10, and the grease A having the higher kinematic viscosity was applied to the pressing unit 50.

(Experimental Result)

An effect of the fixing apparatus according to the present exemplary embodiment was confirmed by experiments. According to the image forming apparatus in the present experiment, the heater 15 is controlled at the target temperature 200° C. when the full color print is performed by the image forming apparatus put in the environment at the atmospheric temperature of 15° C. in the fixing mode for performing fixing on, for example, a sheet having a basis weight of 80 $g/m^2$. The fixing roller temperature and the pressing film temperature were not controlled, however, when temperatures were measured by the non-contact temperature meter, the fixing roller temperature was 150° C. and the pressing film temperature was 70° C. at immediately before the sheet P entering into the fixing nip portion N1 in the heating operation.

In the measurement of the frictional force Fh, a state is set in which the pressing unit 50 is separated from the fixing roller 30, and only the heating unit 10 is driven by the fixing roller 30. Then, the frictional force Fh was obtained in such a manner that the heater 15 was energized and controlled to be the target temperature of 200° C. while the fixing roller 30 was rotationally driven, and the torque Th on the core metal shaft of the fixing roller 30 was measured by the torque measurement apparatus. The method for obtaining the frictional force Fp is described below. The fixing roller 30 is rotationally driven by abutting the heating unit 10 and the pressing unit 50 on the fixing roller 30. Further, the heater 15 is energized to heat the fixing roller 30 and the pressing unit 50, and then energization of the heater 15 is stopped and the heating unit 10 is separated from the fixing roller 30. Subsequently, the fixing roller 30 is rotated again, and the torque Tp on the fixing roller shaft is measured when the temperature of the pressing film 51 becomes 70° C. Measurement results are presented in Table 3 below.

TABLE 3

| | heating unit grease | pressing unit grease | Th (kgfcm) | Fh (kgf) | Tp (kgfcm) | Fp (kgf) |
|---|---|---|---|---|---|---|
| present exemplary embodiment | A | B | 2.5 | 2.5 | 1.8 | 1.8 |
| comparative example 1 | B | B | 1.7 | 1.7 | 1.8 | 1.8 |
| comparative example 2 | B | A | 1.7 | 1.7 | 2.4 | 2.4 |

Printing of characters and images was performed using the fixing apparatus and the image forming apparatus in the environment at an atmospheric temperature of 15° C. and a humidity of 15% using common laser beam printer (LBP) print sheets with a basis weight of 80 $g/m^2$ and an A4 size (a width of 210 mm and a length of 287 mm) at an image printing ratio 5%.

According to the image forming apparatus in the present experiment, the heater 15 is controlled at the target temperature 200° C. when the full color print is performed by the image forming apparatus put in the environment at the atmospheric temperature of 15° C. in the fixing mode for performing fixing on, for example, a sheet having a basis weight of 80 $g/m^2$. The fixing roller temperature and the pressing film temperature were not controlled, however, when temperatures were measured by the non-contact temperature meter, the fixing roller temperature was 150° C. and the pressing film temperature was 70° C. at immediately before the sheet P entering into the fixing nip portion N1 in the heating operation. The print mode was set to a mode in which jobs for printing two sheets are performed intermittently at 10-minute intervals. Results obtained by confirming a level of toner soiling on the surface of the heating film 16 and presence or absence of discharge of the toner Tc at a predetermined number of sheets are presented in Table 4.

TABLE 4

| | | 10K sheets | 25K sheets | 50K sheets | 75K sheets |
|---|---|---|---|---|---|
| soiling on heating film 16 | present exemplary embodiment | ○ | ○ | ○ | ○ |
| | comparative example 1 | ○ | Δ | x | x |
| | comparative example 2 | Δ | x | x | x |
| discharge of toner to image | present exemplary embodiment | ○ | ○ | ○ | ○ |
| | comparative example 1 | ○ | ○ | x | x |
| | comparative example 2 | ○ | x | x | x |

An interior of the fixing apparatus was observed when 25000 sheets were printed by the comparative example 2, and adhering substances such as the toner Tc slightly adhered to the heating film 16. However, there was nothing wrong with the fixed toner images on the printed sheets P. When 25000 sheets were further printed, fine-grained toner lumps were found in the fixed toner images on the sheets P. When the interior of the fixing apparatus was observed, adhesion of the toner Tc to the heating film 16 was increased. When 50000 sheets were printed in the comparative example 1, fine-grained toner lumps were found in the fixed toner images on the sheets P. On the other hand, in the configuration according to the exemplary embodiment of the present invention, the adhering substances such as the toner Tc did not adhere to the heating film 16 and discharge of the toner to the images was not observed when 75000 sheets were printed.

As described above, sliding resistance of the inner surface of the heating film 16 becomes higher than sliding resistance of the inner surface of the pressing film 51, and the frictional force Fh for driving the heating film 16 becomes larger than the frictional force Fp for driving the pressing film 51. Accordingly, accumulation of the toner Tc to the heating film 16 is suppressed, and an excellent print image can be maintained as in the case of the first exemplary embodiment.

Figure 12:
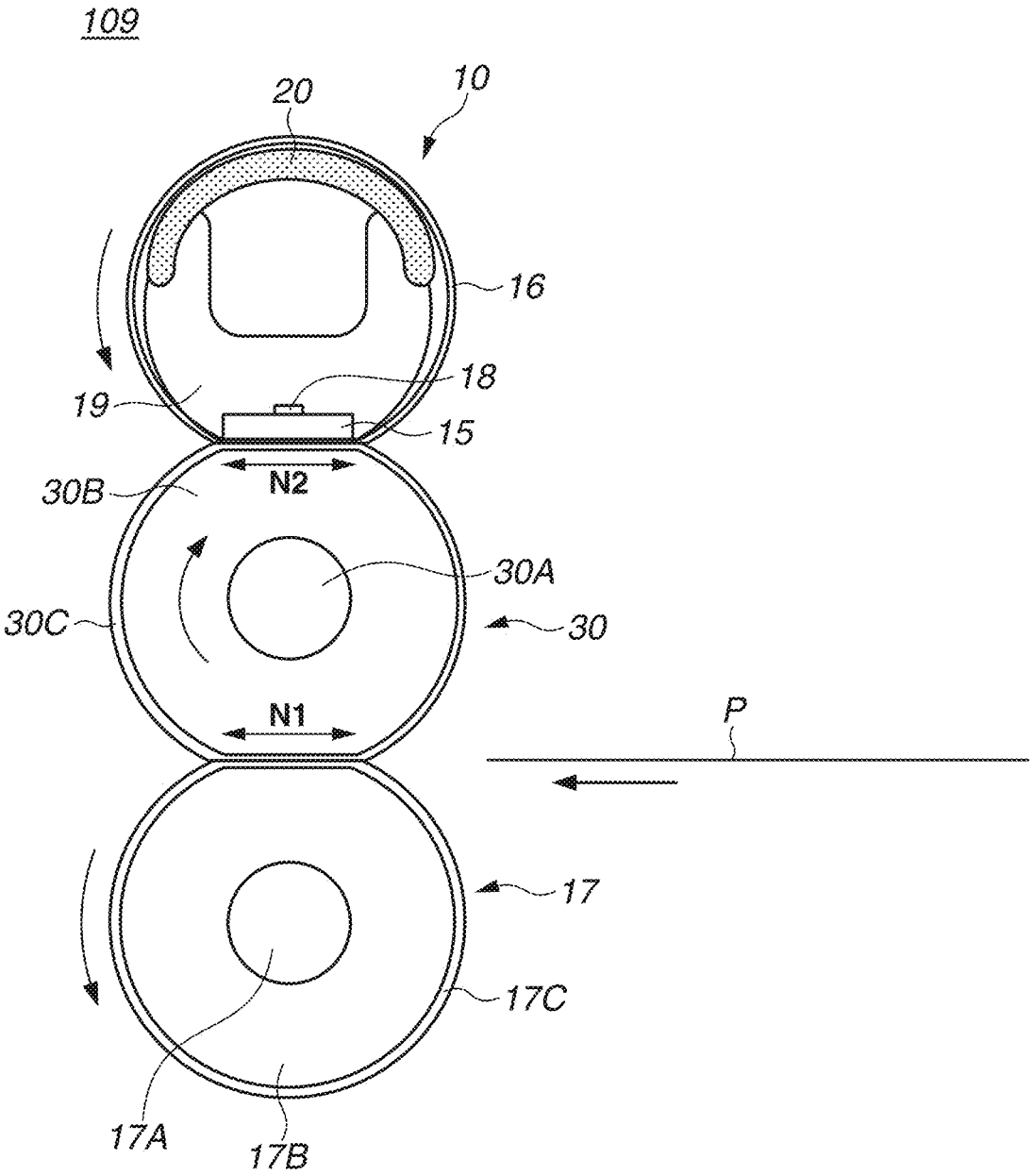
FIG. 12 is a cross-sectional view illustrating a configuration of a fixing apparatus according to a third exemplary embodiment.

The image forming apparatus and the fixing apparatus according to a third exemplary embodiment are similar to those according to the first exemplary embodiment, however, a pressing member for forming the fixing nip portion N1 with the fixing roller 30 is a pressing roller 17 as illustrated in FIG. 12. The pressing roller 17 includes a core metal 17A, an elastic layer 17B formed on an outside of the core metal, and a releasing layer 17C formed on an outside of the elastic layer 17B. The core metal 17A is formed of metal such as aluminum. The elastic layer 17B is formed of silicone rubber and the like. The releasing layer 17C is formed of PTFE, PFA, FEP, or the like. The pressing roller 17 is rotated by the rotation of the fixing roller 30. Similar to the first exemplary embodiment, the heating film 16 is followingly rotated by receiving the frictional force Fh at a contact surface with the fixing roller 30. Further, the pressing roller 17 is followingly rotated by receiving the frictional force Fp at a contact surface with the fixing roller 30.

The present exemplary embodiment is also configured to make the frictional force Fh larger than the frictional force Fp. As a measure to make the frictional force Fh larger than the frictional force Fp, for example, the kinematic viscosity of the grease applied to the inner surface of the heating film 16 as the lubricant is increased similar to the first exemplary embodiment. In addition, the rotational resistance of the pressing roller 17 is reduced by changing an outer diameter of a rotation shaft, a surface property, and a material of the pressing roller 17. In addition to the above ones, measures are not particularly limited as long as a method can realize the above-described conditions. It is desirable that the micro-hardness of the pressing roller 17 according to the present exemplary embodiment is high compared to that of the fixing roller 30. It is because that there is a possibility that the pressing roller 17 is also elastically deformed at the fixing nip portion N1, and the toner Tc transferred to the pressing roller 17 exfoliates and returns to the fixing roller 30. When the micro-hardness of the pressing roller 17 is high, the surface thereof is hardly deformed and suitable for holding the toner Tc. The micro-hardness corresponds to ease of minute deformation on the surface rather than the Asker C hardness.

An effect of the fixing apparatus according to the present exemplary embodiment was confirmed by experiments. The image forming apparatus used in the experiment was similar to that in the first exemplary embodiment except for the pressing unit. The fixing roller 30 of the fixing apparatus 109 is similar to that in the first exemplary embodiment. Regarding the pressing roller 17, the elastic layer 17B made of silicone rubber having thermal conductivity of 0.3 W/m·K and a thickness of 3.0 mm is formed on the iron core metal 17A having an outer diameter 14 mm, and the releasing layer 17C made of PFA resin with a thickness of 40 μm is formed on an outermost layer. The Asker C hardness of the fixing roller 30 was 450, and the Asker C hardness of the pressing roller 17 was 55°. A shaft (not illustrated) of the pressing roller 17 is rotatably supported by a bearing, and a low frictional resistance product adopting ball bearing configuration is used as the bearing. The grease A having the higher viscosity is used for the inner surface of the heating film 16 which is used in the second exemplary embodiment. The heater 15 is pressed to contact with the fixing roller 30 by a pressure of 18 kg via the heating film 16 and forms the heating nip portion N2 with a width of 6 mm. The pressing roller 17 is pressed to contact with the fixing roller 30 by a pressure of 18 kg and forms the fixing nip portion N1 with a width of 6 mm. According to the image forming apparatus in the present experiment, the heater 15 is controlled at the target temperature 200° C. when the full color print is performed by the image forming apparatus put in the environment at the atmospheric temperature of 15° C. in the fixing mode for performing fixing on, for example, a sheet having a basis weight of 80 g/m$^2$.

The fixing roller temperature and the pressing roller temperature were not controlled, however, when temperatures were measured by the non-contact temperature meter, the fixing roller temperature was 150° C. and the pressing roller temperature was 50° C. at immediately before the sheet P entering into the fixing nip portion N1 in the heating operation. The frictional force Fh and the frictional force Fp of the fixing apparatus according to the present exemplary embodiment were respectively 2.5 kgf and 1.0 kgf.

The sheet passing test similar to that according to the first exemplary embodiment was conducted using the present experiment apparatus, and the adhering substances such as the toner Tc did not adhere to the heating film 16 and discharge of the toner to the images was not confirmed when 75000 sheets were printed. Similar to the first and the second exemplary embodiments, the frictional force Fh received by the surface of the heating film 16 from the surface of the fixing roller 30 is made larger than the frictional force Fp received by the surface of the pressing roller 17 from the surface of the fixing roller 30. Accordingly, accumulation of the toner Tc to the heating film 16 is suppressed, and an excellent print image can be maintained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-110383, filed May 29, 2015, which is hereby incorporated by reference herein in its entirety.

What is claimed is:

1. A fixing apparatus for fixing a toner image on a recording material while conveying and heating the recording material on which a toner image is formed at a nip portion, the fixing apparatus comprising:

a roller;

a heating rotation member configured to form a pressure portion by contacting the roller, the heating rotation member being rotated by rotation of the roller; and a pressing rotation member configured to form a nip portion by contacting the roller, the pressing rotation member being rotated by the rotation of the roller, wherein micro-hardness of a surface of the heating rotation member at the pressure portion and micro-hardness of a surface of the pressing rotation member at the nip portion are both higher than micro-hardness of a surface of the roller, and wherein frictional force acting on the roller at the pressure portion is larger than frictional force acting on the roller at the nip portion.

2. The fixing apparatus according to claim 1, wherein urging force of the heating rotation member toward the roller is equivalent to urging force of the pressing rotation member toward the roller.

3. A fixing apparatus for fixing a toner image on a recording material while conveying and heating the recording material on which a toner image is formed at a nip portion, the fixing apparatus comprising:

a roller;

a heating unit configured to heat the roller, the heating unit including a first film having a cylindrical shape, a pressure portion forming member configured to form a pressure portion with the roller via the first film by contacting an inner surface of the first film, and a first regulating member configured to regulate an inner surface of an end portion of the first film with respect to a generatrix direction of the roller; and a pressing unit configured to form a nip portion with the roller, the pressing unit including a second film having a cylindrical shape, a nip portion forming member configured to form the nip portion with the roller via the second film by contacting an inner surface of the second film, and a second regulating member configured to regulate an inner surface of an end portion of the second film with respect to the generatrix direction of the roller, wherein the first film and the second film are rotated by rotation of the roller, wherein micro-hardness of a surface of the first film at the pressure portion and micro-hardness of a surface of the second film at the nip portion are both larger than micro-hardness of a surface of the roller, and wherein an area of a first protruding region of the first film is larger than an area of a second protruding region of the second film, the first protruding region being a region where an outline of the first film in a case where the first regulating member is provided protrudes outside from an outline of the first film in a case where the first regulating member is removed on a cross section of the first film perpendicular to the generatrix direction of the roller, the second protruding region of the second film being a region where an outline of the second film in a case where the second regulating member is provided protrudes outside from an outline of the second film in a case where the second regulating member is removed on a cross section of the second film perpendicular to the generatrix direction of the roller.

4. The fixing apparatus according to claim 3, wherein urging force of the heating unit toward the roller is equivalent to urging force of the pressing unit toward the roller.

* * * * *